US006604645B1

(12) United States Patent
Vaupotic

(10) Patent No.: US 6,604,645 B1
(45) Date of Patent: Aug. 12, 2003

(54) CONTAINER LID AND IMPLEMENT

(75) Inventor: Vladimir Vaupotic, Dandenong (AU)

(73) Assignee: Auslid Enterprises Pty LTD A.C.N., Victoria (AU)

( * ) Notice: Subject to any disclaimer, the term of this patent is extended or adjusted under 35 U.S.C. 154(b) by 0 days.

(21) Appl. No.: 09/508,911

(22) PCT Filed: Sep. 19, 1998

(86) PCT No.: PCT/AU98/00776

§ 371 (c)(1),
(2), (4) Date: Jun. 19, 2000

(87) PCT Pub. No.: WO99/15423

PCT Pub. Date: Apr. 1, 1999

(30) Foreign Application Priority Data

Sep. 19, 1997 (AU) ..... PO9315

(51) Int. Cl.[7] ..... B65D 41/56; B65D 51/32

(52) U.S. Cl. ..... 220/212; 206/542; 220/780; 220/257

(58) Field of Search ..... 220/212, 780, 220/254, 259, 257, 258, 265, 266, 267, 268, 269; 206/216, 541, 542

(56) References Cited

U.S. PATENT DOCUMENTS

| | | | | | |
|---|---|---|---|---|---|
| 3,334,778 | A | * | 8/1967 | Saunders | 220/212 |
| 3,364,937 | A | * | 1/1968 | D'amaro | 220/212 |
| 3,487,974 | A | * | 1/1970 | Schovee | 220/212 |
| 3,730,372 | A | * | 5/1973 | Komendowski | 220/212 |
| 4,060,176 | A | * | 11/1977 | Tobiasson | 220/212 |
| 4,216,875 | A | | 8/1980 | Stanish | |
| 5,443,174 | A | * | 8/1995 | Bauer | 220/212 |
| 5,695,084 | A | | 12/1997 | Chmela et al. | |
| 5,705,212 | A | | 1/1998 | Atkinson | |
| 5,791,505 | A | * | 8/1998 | Gilliland | 220/212 |

FOREIGN PATENT DOCUMENTS

| | | |
|---|---|---|
| FR | 2747107 | 10/1997 |
| GB | 2318784 | 5/1998 |
| JP | 07277356 | 10/1995 |
| JP | 10053271 | 2/1998 |
| WO | WO 95/07847 | 3/1995 |

OTHER PUBLICATIONS

Aaron L Brody & Kenneth S Marsh (Eds.), "The Wiley Encyclopedia of Packaging Technology Second Edition," published 1997, by Wiley—Interscience, received in IP Australia, Mar. 20, 1997 p. 213 "Tear bands," and pp. 879–882.

* cited by examiner

*Primary Examiner*—Stephen P. Garbe
*Assistant Examiner*—Niki M. Eloshway
(74) *Attorney, Agent, or Firm*—Allen, Dyer, Doppelt, Milbrath & Gilchrist, P.A.

(57) ABSTRACT

A lid (2) for a container (1) which lid comprises: a cover portion (5) adapted to extend over the container (1); an implement (3) adapted for use with contents (27) of the container, and a hinge (4, 6) connecting the cover portion (5) to the implement (3), wherein the implement is adapted to be rotated about the hinge (4, 6) into a storage position in which the implement lies against the cover portion. The cover portion may also be provided with an anti-tamper device or a tamper resistant or tamper proof arrangement.

41 Claims, 4 Drawing Sheets

CONTAINER LID AND IMPLEMENT

The present invention relates generally to lids and to containers with lids, particularly lids having implements for use in removing the contents of the container. More particularly, the present invention relates to lids having an integral implement in which the lid is tamper proof or is provided with a means indicating that the lid has been interfered with. Even more particularly, the present invention relates to a lid and a container having a lid in which the integrally mounted implement is arranged for rotation between a stored position and an in use position and in which the lid is provided with a tamper proof sealing strip providing a visual indication that the lid has been previously removed or at least disturbed from its original position.

Although the present invention will be described by reference to one form of the lid having an integral implement and a tamper proof sealing strip it is to be noted that the scope of the present invention is not limited to the described embodiment but rather the scope of the present invention extends to include other arrangements of the lid and its use in other applications.

BACKGROUND TO THE INVENTION

It is known to provide many foods such as, snack foods, convenience foods, takeaway foods, ice-cream, yoghurt, preserved fruit salads, meals such as Asian meals, casseroles, and such like, spreads and the like in containers having a bowl or tub portion for containing the contents in which the container is provided with an upper peripheral rim located around the edge of the opening of the container to which is fitted a lid having a cover portion and a peripheral skirt in which the peripheral skirt engages with the upper edge of the peripheral rim to close or seal the container, regardless of the size of the container. However, it is to be noted that the lid and container and lid combination of the present invention is not restricted to food containers but rather finds application in containers for a variety of materials, not just food.

In some instances a sealing sheet or film which is breakable may extend across the opening defined by the upper peripheral rim and in this instance the lid is usually provided for the purpose of protecting the breakable sealing sheet or film in transit or for re-closing or resealing the container after the sealing sheet has been broken where useable contents remain in the container or reuse at a later time.

In many instances it is the desire of a consumer to eat the food within the container by using an implement such as an eating implement such as a spoon, fork, knife, spade, chopsticks or the like. Other forms of the implement include measuring scoops or dosage units for medicines.

It may also be a desire of a consumer to eat such food in a place, say away from home, where such implement is not readily available and this may be inconvenient.

It is accordingly desirable to provide such an implement with the container and its contents, preferably an integral implement.

Another problem with containers, concerns authorised access to the contents of the container particularly containers for foods, in that the containers can be tampered with or otherwise interfered with so that the contents can be contaminated or adulterated. It has been known for extortionists, terrorists, criminals or the like to remove food packages from supermarket shelves, contaminate the contents and return the containers to the shelves with the aim of either injuring members of the public, or obtaining money from the supermarket or food producer or the like. Hence there is a need to provide some indication on the containers that the lid has been removed without authorisation ie that the container has been tampered with.

It is accordingly desirable to provide a container, particularly a container with a lid having an integral implement with a means of indicating whether or not there has been unauthorised access to the contents of the container by providing the container with a tamper resistant or tamper proof arrangement.

The present invention is not confined to containers for foods as many substances are supplied in containers and require for their use or consumption the use of an implement, and/or to know whether the contents have been tampered with.

SUMMARY OF THE INVENTION

According to the present invention there is provided a lid for a container which lid comprises:

- a cover portion adapted to extend over the container;
- an implement adapted for use with contents of the container to assist in removal of the contents from the container; and
- a hinge connecting the implement to at least one part of the cover portion or to one part of the lid; wherein the implement is adapted to be rotated about the hinge into a storage position in which the implement lies against or is in close proximity to a part of the cover portion.

According to another aspect of the present invention there is provided a lid for a container in which the lid comprises:

- a cover portion adapted to extend over the container said cover being provided with engaging means for engaging with the container to attach the lid to the container in use;
- an implement adapted for use with contents of the container to assist in removal of the contents from the container; and
- a hinge connecting the implement to the cover portion;
- wherein the implement is adapted to be rotated about the hinge into a storage position in which the implement lies against or in close proximity to the cover portion; and
- wherein the lid further comprises means for providing an indication that there has been an unauthorised attempt to remove or interfere withe the lid and/or container.

PREFERRED ASPECTS OF THE INVENTION

Typically, the hinge allows the implement to rotate between an extended position in which the implement extends outwardly of the lid or cover portion and the storage position in which the implement is aligned within the cover portion. More typically, the implement is rotatable through an angle of about 180° between the extended position and the storage position.

Typically, the implement is detachable from the cover portion at the hinge by a user. More typically, the implement is detachable by rotating the implement in the opposite direction to the direction of rotation from the extended position to the storage position.

Preferably, the hinge comprises at least one frangible tab. More typically, the frangible tab is broken by reverse rotation of the implement.

Typically, the cover portion, the implement and the hinge are formed integrally with each other. More typically, the lid is formed with the integral implement in the or an extended position.

The cover portion further includes retaining means adapted to retain the implement in the storage position. More typically, the retaining means is a clip or a pair of spaced apart bars. Even more typically, the clip is provided on one or more side edges of the implement, particularly for cooperatively engaging with a portion of the cover.

Typically, the cover portion is provided with a recess, preferably, a recess located on the inner surface of the lid in use. More typically, the recess is of a complementary or corresponding shape to the implement.

When the implement is in the storage position, at least a part of the implement may be received in the recess formed in the cover portion. More typically, the edge of the implement cooperatively engages with a side wall of the recess to retain the implement in the recess.

It is preferred that the recess is defined at least in part by a stiffening rib formed in the cover portion.

Where a recess is present in the cover portion, the recess may be adapted to retain the implement in the storage position.

The implement may comprise means whereby a user may grip the implement to unfold the implement from the storage position.

It is preferred, for a lid in any of the above forms, that when the lid is positioned on the container and when the implement is in the storage position, there is defined a cavity between the container and the cover portion and the implement is contained within the cavity.

Preferably, for a lid in any of the above forms, at least one flat panel is formed in the cover portion.

Where a plurality of such flat panels is formed in the cover portion, it is preferred that such flat panels are coplanar with each other and/or with other portions of the cover portion.

Preferably, for a lid in any of the above forms, there is formed on the cover portion a surface adapted to abut an upper peripheral rim of the container or to abut a sealing sheet adhering to such upper peripheral rim in order to assist in attachment of the lid to the container.

Typically, the implement can take a number of different forms. One form of the implement comprises a pair of arcuate arms arranged on either side of the actual implement. Typically the arms are joined together along a fold line at their respective distal ends. More typically, each arm is connected to the stem of the implement adjacent to the hinge connecting the implement to the cover portion. Even more typically, the arms are connected to the stem about respective fold lines so that in use the arms may be respectively rotated in directions towards each other to form a handle for the implement. More typically, the arms are provided with fastening means for securing the two arms to each other. Even more typically, the implement is provided with a fold line located in the stem of the implement so that the distal portion of the implement may be folded upon the proximal portion in order for the implement to be angularly inclined to the arms when secured to each other to form the handle. More typically, the two foldable portions of the implement are provided with complementary fastening means for holding the two portions together.

Typically, the embodiment of the implement having a handle portion and a head portion angularly inclined to each other extends the length of the implement beyond the size or dimensions of the container so that the contents of the container are more accessible to facilitate removal of the contents.

Typically, the lid is provided with engagement means allowing containers to which the lid is attached to be stackable or nestable with respect to each other so that the containers can be stacked one upon the other in an array.

Typically, the lid and/or cover portion is provided with an anti-tamper device or a tamper-resistant or tamper-proof arrangement for providing an indication that there has been unauthorised access to the container, lid, cover portion or the like. In one form, the anti-tamper device or similar is located either in full or in part way around the edge of the lid.

Typically, the lid may further comprise a peripheral skirt adapted to engage with at least a part of an upper peripheral rim of the container.

The peripheral skirt may be integrally formed with the cover portion.

The peripheral skirt may comprise a lip adapted to engage an underside of the upper peripheral rim of the container thereby to secure the lid to the container.

It is preferred that a frangible region is formed in the lid at the junction between the cover portion and the peripheral skirt, so that a user may separate the peripheral skirt from the cover portion along at least a part of the length of the peripheral skirt to assist in gaining access to the contents of the container and/or to remove the lid from the container.

The frangible region may extend along a part only of the junction between the cover portion and the peripheral skirt so that the lid may be removed from the container by separating the peripheral skirt from the cover portion at the frangible region without fully separating the peripheral skirt from the cover portion.

The frangible region may take the form of a groove formed in the cover portion and/or the peripheral skirt.

Alternatively, the frangible region may take the form of a series of slots defining frangible tabs therebetween.

The peripheral skirt may further include a tab adapted to be grasped and pulled by a user to separate the peripheral skirt from the cover portion at the frangible region. If the frangible region has been interfered with, broken, removed or otherwise disturbed, this provides an indication that the container and/or lid has been tampered with.

In a particularly preferred form of the lid, the periphery of the cover portion is of generally rectangular shape with at least one rounded corner, the hinge is at one corner of the cover portion, and the implement is elongate and when in the storage position lies at least approximately along a diagonal of the generally rectangular shape.

Typically, the frangible region does not extend into the region of where the hinge is located so that when the peripheral skirt is separated from the cover portion the area around the hinge remains intact, thus maintaining the implement integrally with the cover portion.

The cover portion and the implement are preferably moulded from a flexible plastics material.

It is particularly preferred that the flexible plastics material is at least substantially transparent.

In another aspect of the invention, there is provided, in combination, a container and lid wherein the container comprises at least one tub or bowl portion and has an upper peripheral rim, and wherein the lid is in any of the forms described above. More typically, the peripheral skirt of the lid co-operatively engages with the upper peripheral rim of the container to close or seal the lid to the container.

In such a combination of a container and a lid, the container may further comprise a sealing membrane adhering to the upper peripheral rim of the container. More typically, the sealing membrane is located between the implement and the opening of the container.

In another aspect of the invention there is provided a method of manufacturing a lid for a container comprising moulding the cover portion, implement and hinge integrally with each other, with the implement in a position on completion of such moulding wherein the implement is in a position distinct from the storage position and thereafter rotating the implement about the hinge into the storage position.

Typically, the invention further includes integrally forming the peripheral skirt and frangible region between the skirt and the cover.

The invention will now be described in more detail by way of non-limiting examples as shown in the accompanying drawings.

DETAILED DESCRIPTION WITH RESPECT TO THE DRAWINGS

Figure 1:
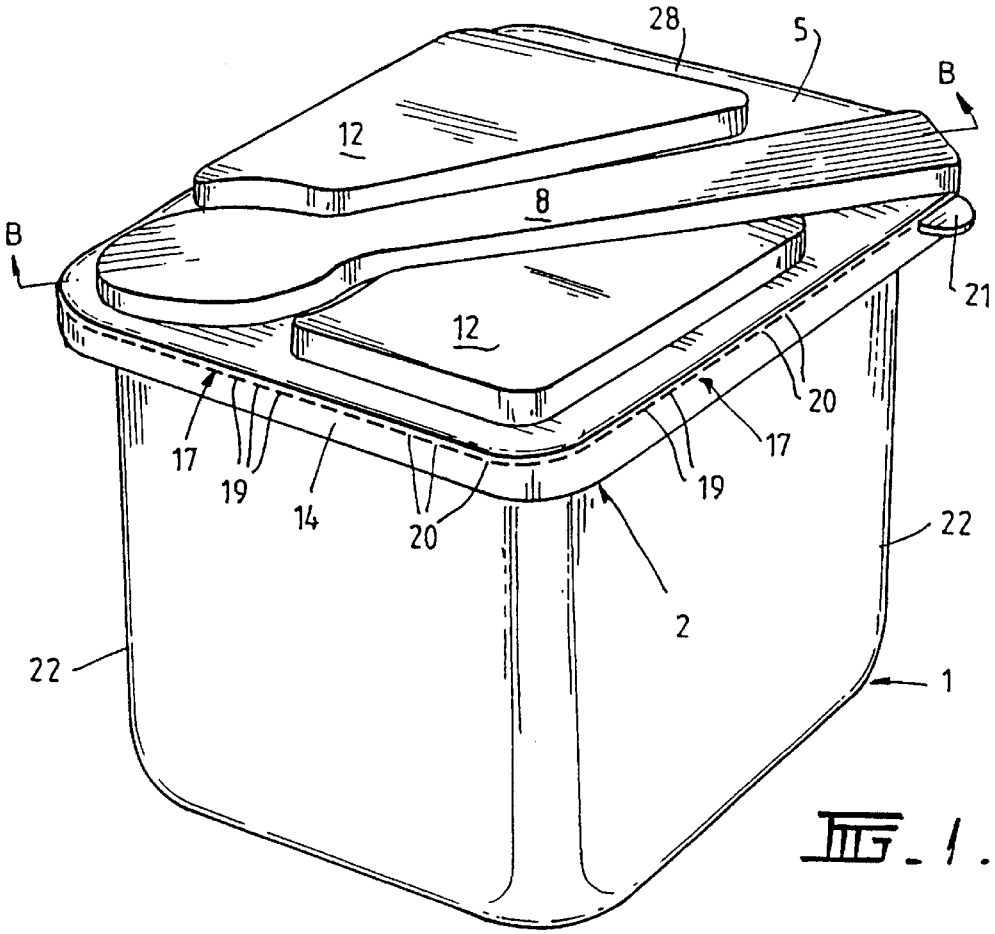
FIG. 1 is a perspective view of a container fitted with one form of the lid according to the present invention.

One form of the lid, generally denoted as 2, according to the present invention, is shown in FIG. 1 in position on a container generally denoted as 1. The lid 2 comprises a cover portion 5 and a peripheral skirt 14.

Cover portion 5 extends fully over the upper opening 26 of container 1. The peripheral skirt 14 of lid 2 extends partly around the periphery of cover portion 5 and abuts the outer edge of upper peripheral rim 23 of container 1W thus laterally locating lid 2 in position on container 1.

Peripheral skirt 14 comprises a downwardly depending lip 15 arranged to extend along the edge of peripheral skirt 14 remote from cover portion 5. Lip 15 is adapted to engage the underside 16 of the upper peripheral rim 23 of container 1, at least if and when the attempt is made to lift lid 2 off container 1, and so assists in retaining lid 2 in position on container 1.

Figure 4:
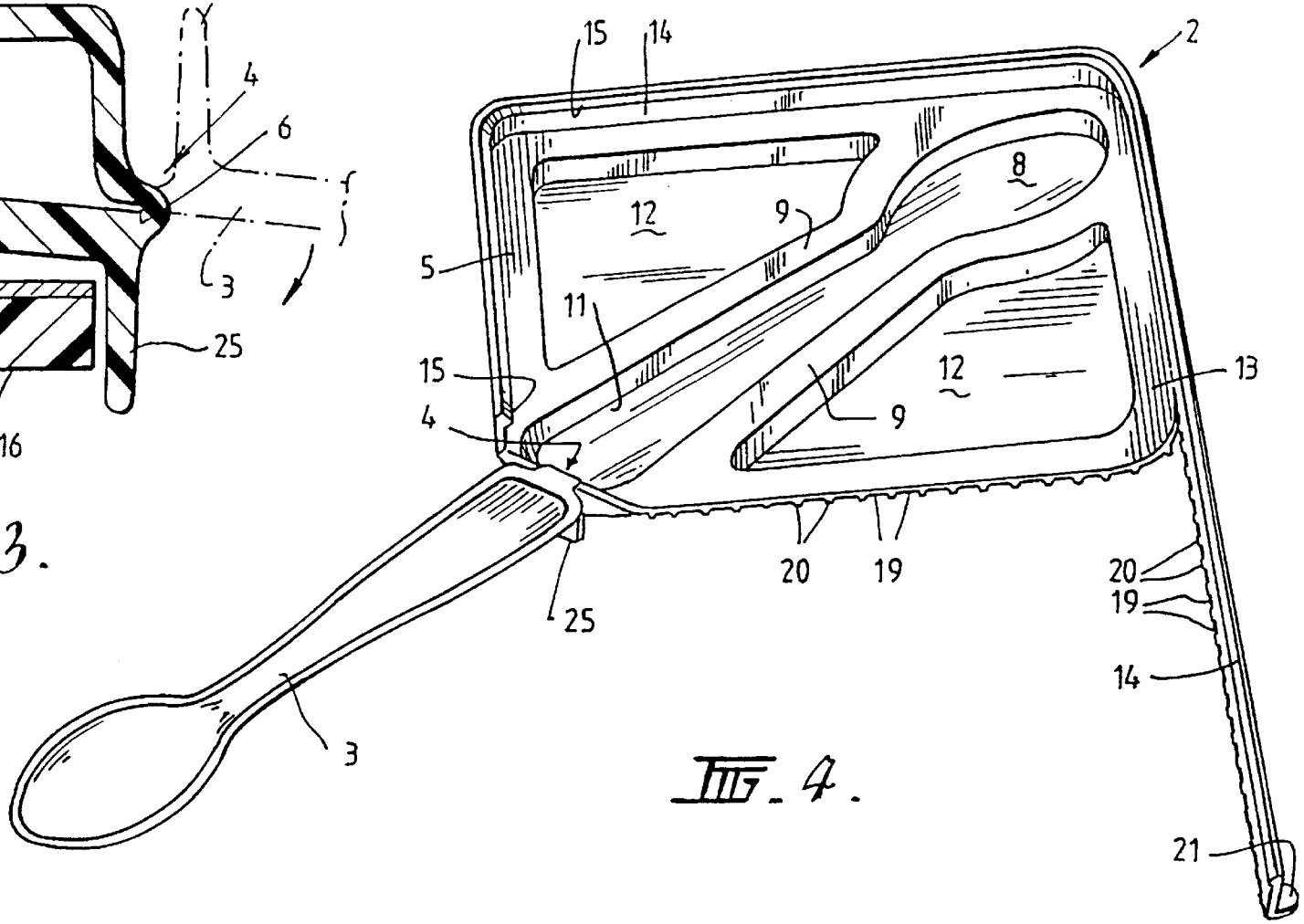
FIG. 4 is an underneath perspective view of the lid shown in FIG. 1, wherein the lid is inverted and the implement is shown in the extended position.

As shown in FIG. 4, peripheral skirt 14 extends around the periphery of cover portion 5, except in the region where an implement 3 is secured to cover portion 5 by a hinge 4. In one embodiment hinge 4 comprises a frangible tab 6, so that when the implement 3 is in a position such as that shown in FIG. 4 which is the extended position implement 3 may be detached from cover portion 5 by breaking frangible tab 6, particularly by rotating the implement out of the plane away from the storage position. Implement 3, when thus detached from cover portion 5, is ready for use with the contents 27 of container 1.

Figure 2:
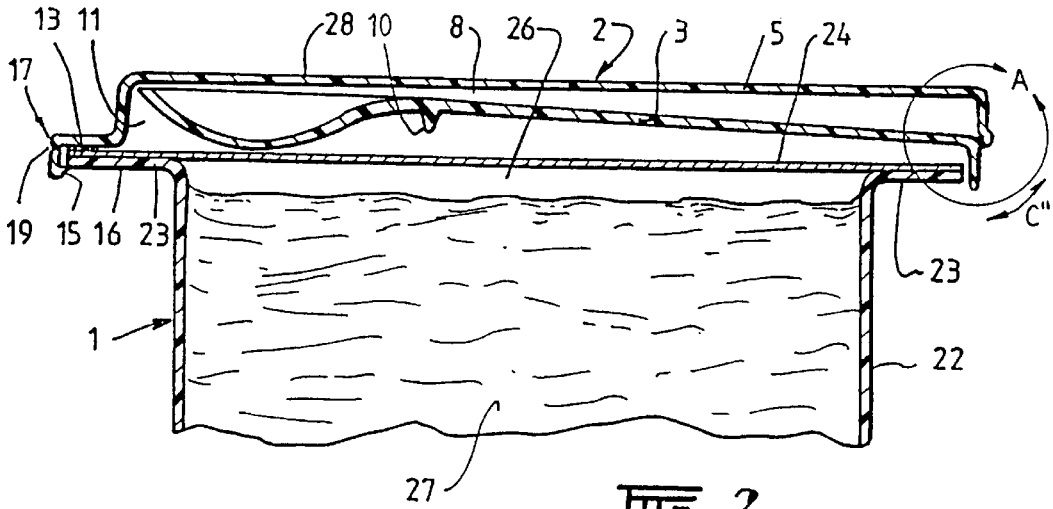
FIG. 2 is a partial vertical section of the container and lid shown in FIG. 1, taken along the line B—B in FIG. 1.

Implement 3, before detachment from cover portion 5, is rotatable about hinge 4 as shown by arrow "C" in FIG. 2. When, before opening of container 1, the lid 2 is in position on container 1 as shown in FIG. 2, implement 3 is in the storage position in which it is received in a recess 8 formed in cover portion 5 and lies against cover portion 5. Recess 8 is defined in part by stiffening ribs 9 formed in cover portion 5 as shown in FIG. 4.

Implement 3, when received in recess 8, is slightly wedged in to recess 8 to retain it in position. The position of implement 3 when it is received in recess 8 is here termed the "storage position".

Referring to the partial cross-sectional view of FIG. 2, implement 3 is shown in the storage position. It will be noted that with lid 2 in position on container 1, there is defined a cavity 11 within which implement 3 is contained. Implement 3 is thereby kept clean until it is detached from cover portion 5, ready for use.

As shown in FIG. 2, a sealing membrane 24 adheres to the upper peripheral rim 23 of container 1, and serves to prevent leakage or spoiling of the contents 27. Sealing membrane may be peeled from container 1 after removal of lid 2. It is to be noted that sealing membrane 24 is optional.

It has been found that cover portion 5, implement 3, hinge 4 and peripheral skirt 14 may be moulded integrally, as a single component, with the implement 3 and cover portion 5 in relative positions such as that shown in FIG. 4, notwithstanding the presence on peripheral skirt 14 of lip 15. In preparation for placement of lid 2 on container 1, implement 3 is rotated about hinge 4 into the storage position.

Figure 3:
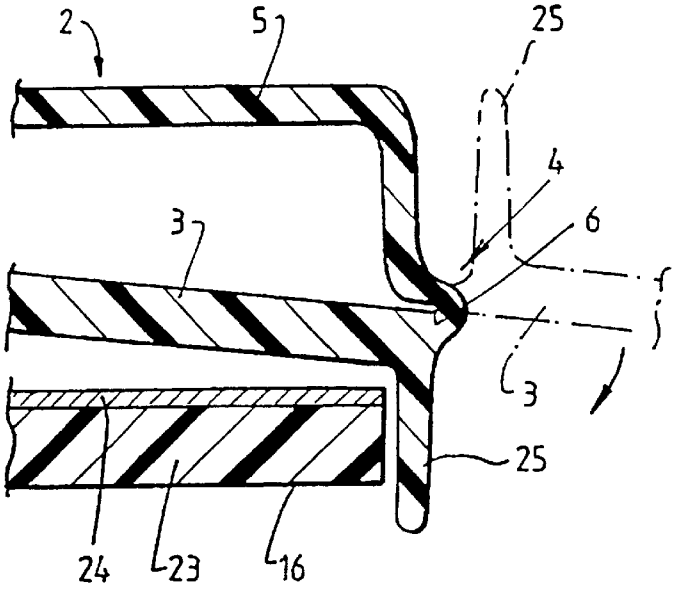
FIG. 3 is an enlarged cross-sectional view of the area at "A" in FIG. 2.

FIG. 3 shows in partial cross-section, two positions of implement 3. In chain-dotted lines is shown the position of implement 3 referred to above as suitable for moulding of lid 2 as a single component which is the extended position and in solid lines is shown implement 3 in storage position.

Hinge 4, comprising a frangible tab 6 is required to enable about 180° of rotation of implement 3 and is achievable through the use of suitable flexible plastics materials known in the art.

FIG. 3 shows, also, a projection 25 on implement 3 which, when implement 3 is in the storage position, lies adjacent to the outer edge of upper peripheral rim 23 of container 1 to restrict entry of foreign objects into cavity 11. Peripheral skirt 14 of lid 2 does not extend along that part of the periphery of cover portion 5 adjacent to which projection 25 lies when implement 3 is in the storage position.

Formed in cover portion 5 are several flat panels 12 which, when lid 2 is made of a transparent plastics material, facilitate viewing of sealing membrane 24 through cover portion 5, for example to view a use-by date marked thereon. Alternatively, the several flat panels 12, being coplanar, may have an adhesive label attached thereto.

Also formed in cover portion 5 is a surface 13 which extends around the periphery of cover portion 5 and, when lid 2 is in position on container 1, abuts either the sealing membrane 24 or the upper peripheral rim 23 of container 1.

FIG. 4 shows peripheral skirt 14 of lid 2 partially detached from cover portion 5. To enable such partial detachment of peripheral skirt 14 from cover portion 5 by a user, a frangible region 17 is incorporated in lid 2 at the junction between peripheral skirt 14 and cover portion 5. In the example of lid 2 shown in FIGS. 1 to 4, the frangible region 17 comprises a series of slots 19 defining frangible tabs 20 therebetween. A user, wishing to remove lid 2 from container 1, may grip a tab 21 provided on one end of peripheral skirt 14 and peel peripheral skirt 14 clear of cover portion 5.

Frangible region 17 need not, and does not, in the particular example shown in FIGS. 1 to 4, extend along the whole length of peripheral skirt 14, so that complete detachment from cover portion 5 is discouraged. This may be advantageous in reducing litter, as it is tempting to improperly dispose of very small items such as peripheral skirt 14.

It will be appreciated that since removal of lid 2 from container 1 requires partial peeling off of peripheral skirt 14, an intending user will be able to see whether the lid 2 has been previously removed and is a clear indication that the container and lid have been interfered with. Thus, the peripheral skirt acts as an anti-tamper device or arrangement and provides a tamper resistant or tamper proof means.

In FIGS. 1, 2 and 4, implement 3 is shown as a spoon, although of course, other types of implement are possible, including knives, forks, splades, chop sticks, scoops and the like.

To assist in rotating implement 3 out of the storage position for detachment from cover portion 5 and use, grip means 10 in the form of a small projection, is provided on the underside of implement 3.

Figure 5:
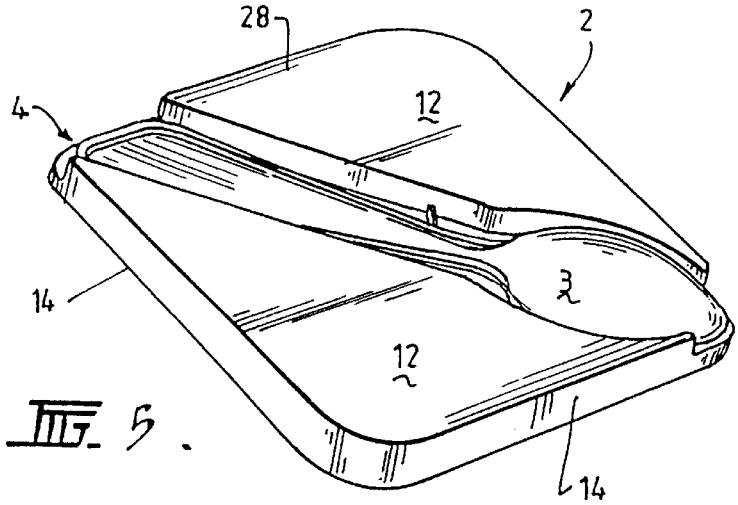
FIG. 5 is a perspective view of a further lid according to the invention showing the implement in the storage position.
Figure 6:
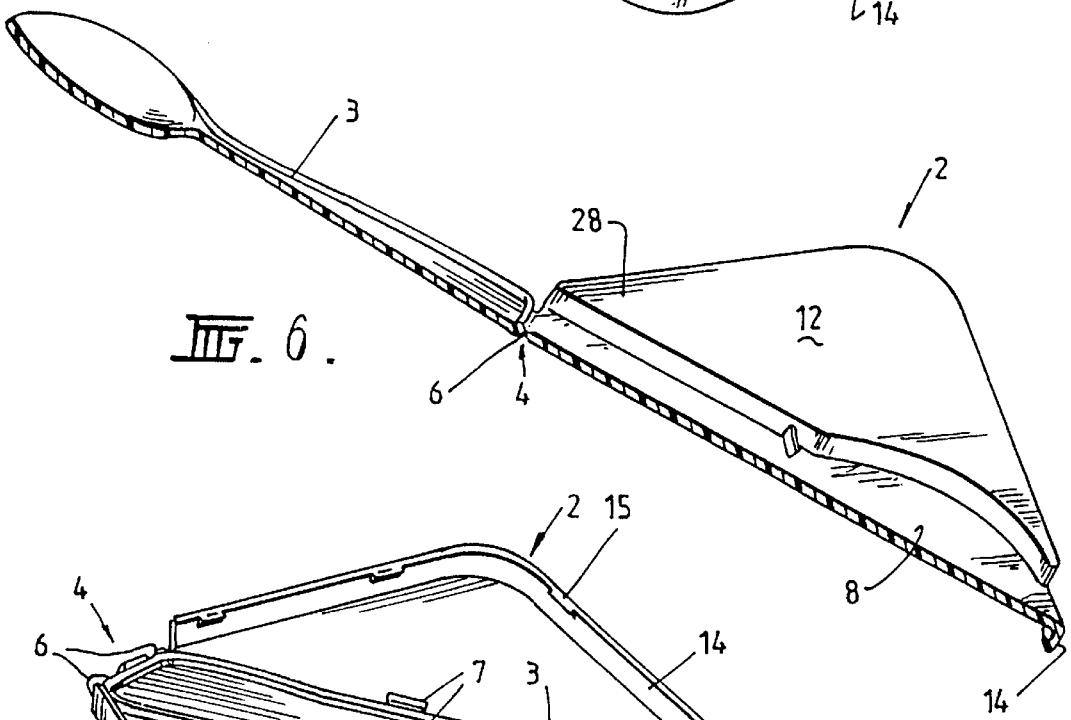
FIG. 6 is a perspective cutaway view of the lid shown in FIG. 5 but with the implement in the extended position.

FIGS. 5 and 6 show another lid according to the invention. In this form, implement 3 is shown in a storage position on the outside face 28 of cover portion 5.

Figure 7:
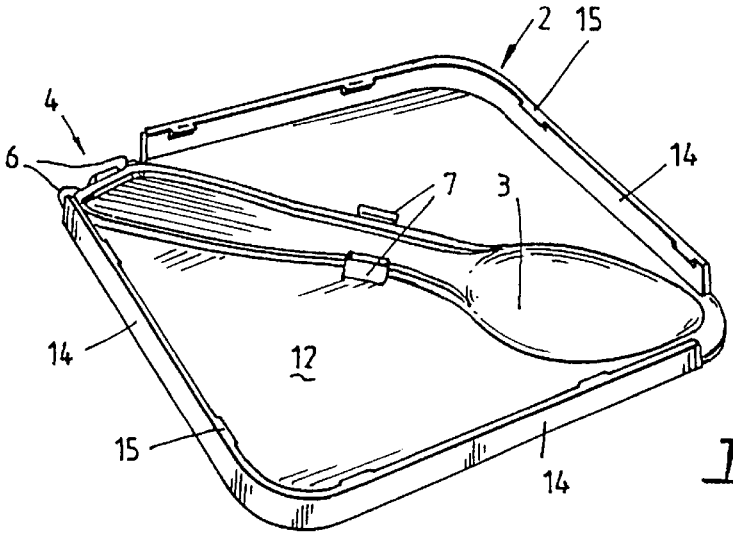
FIG. 7 is a perspective view of a further lid according to the invention but with the implement retained in the storage position by clips.

FIG. 7 shows yet another lid according to the invention. In this case, the outside face 28 of cover portion 5 is a flat surface, and lip 15 is not continuous along peripheral skirts 14.

Additionally the implement 3 is retained in the storage position by a suitable retaining means such as clip 7 on cover portion 3.

The lids shown in FIGS. 5, 6 and 7 are adapted to be pried off container 1, without peeling off of peripheral skirt 14.

Figure 8:
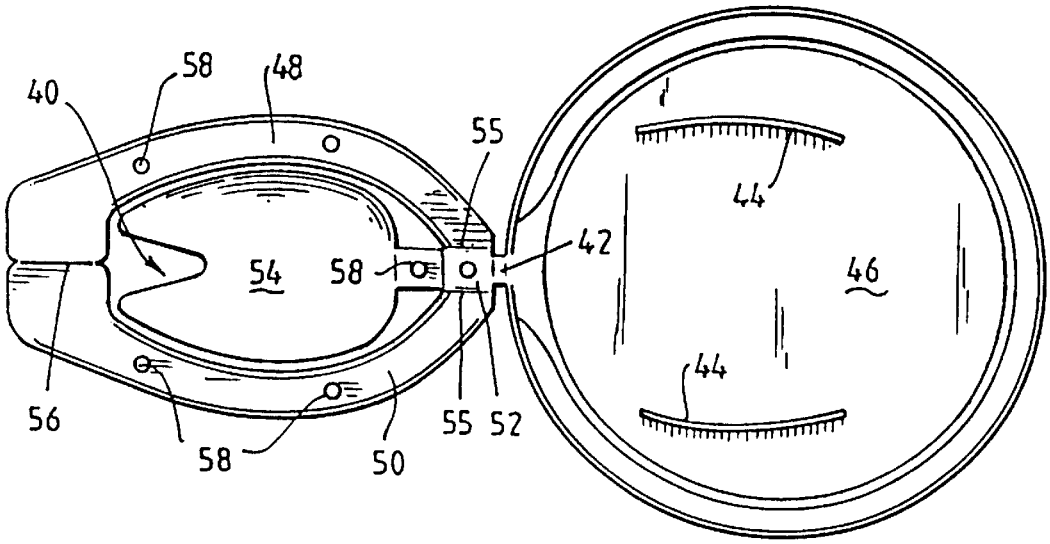
FIG. 8 is a top plan view of another embodiment of the lid of the present invention having a modified form of the implement in which the actual implement is surrounded by two foldable arms.
Figure 9:
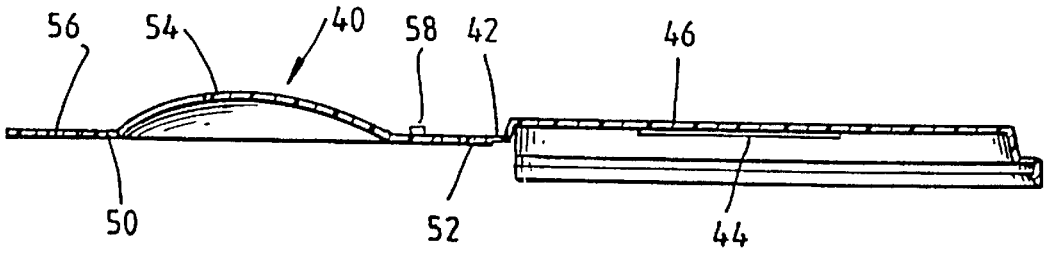
FIG. 9 is a side elevation view of the embodiment of FIG. 8.

With particular reference to FIGS. 8 and 9, another embodiment of the lid of the present invention will now be described.

This embodiment has a modified form of the implement in which the implement, generally devoted as 40, is connected to the lid portion by hinge 42 allowing rotation of the implement between the storage position and the extended position. Implement 40 is retained in the storage position by a pair of spaced apart bars 44 provided in the undersurface of cover portion 46 which bars cooperate with the edge of the implement. Implement 40 has a pair of generally arcuate arms 48, 50 extending from the central part 52 of the stem portion of implement 40 which is the portion connected to hinge 42. The other ends of arms 48,50 are joined together at their respective distal ends so as to form an annulus like arrangement around the implement, particularly the head 54 of the implement in this case a fork.

Arms 48,50 are connected to central portion 52 by fold lines 55 and are interconnected together at their respective distal ends along fold line 56. Thus, arms 48,50 are rotatable between a planar position as shown in FIGS. 8 and 9 and an in use position in which the arms are squeezed together out of the plane of fork 54 by rotating along the respective fold lines to form a handle for the implement. Typically, the two arms are folded towards each other so as to adopt a position transverse to the plane containing head 54 of the fork. More typically, the two arms are folded to extend substantially perpendicularly from the plane containing the head of the implement.

The arms are provided with complementary fastening means 58 for retaining the two arms securely together in side by side relationships to form the handle of the implement. One form of the complementary fastening means includes a stud or post and holes into which the stud or posts are received.

When the studs or posts are received in the aligned holes the two arms are held together which forms a handle for the implement and provides sufficient strength to be able to manipulate fork 54 in use when detached from the cover by breaking the frangible tab forming hinge 52.

Additionally, the stem of the implement is provided with a fold line so that the head of fork 54 is rotatable about central stem part 42 and fastenable thereto to retain the head of fork 54 in a fixed orientation with respect to the arms when in the raised handle configuration. In this arrangement the head of fork 54 extends outwardly from the arc of the arms and thus fork 54 is angularly inclined with respect to the arms. This orientation allows more of the contents of the container to be removed since the implement can be manipulated within the container closer to the wall and base of the container. The effect of the rotatable arms of the implement are to lengthen the length of the implement by forming a handle which extends the length of the implement beyond the size or dimensions of the container and/or lid.

It will be recognised that many variations may be made without departure from the spirit or ambit of the invention.

For example, frangible region 17 may be formed by providing a groove instead of slots 19 and tabs 20 along the junction between peripheral skirt 14 and cover portion 5 so that their connection is thereby weakened.

The described arrangement has been advanced by explanation and many modifications may be made without departing from the spirit and scope of the invention which includes every novel feature and novel combination of features herein disclosed.

Those skilled in the art will appreciate that the invention described herein is susceptible to variations and modifications other than those specifically described. It is understood that the invention includes all such variations and modifications which fall within the spirit and scope.

What is claimed is:

1. A lid for a container comprising a cover portion adapted to extend over a container, said cover portion comprising a side skirt having an upper part and a lower part extending continuously around the perimeter of the cover portion for engaging with the container to attach the cover portion to the container in use, an implement adapted for use with contents of the container to assist in removal of the contents from the container and a hinge connecting the implement to the lower part of the side skirt, said lower part of the side skirt having no gaps or spaces in the region where the hinge is connected to the lower part of the side skirt, said hinge allowing the implement to be rotated about the hinge between a storage position in which the implement lies against or is in close proximity to a part of the cover portion and an in use position in which the implement extends outwardly of the lid or cover portion to enable the implement to be used to remove contents from the container, said implement including a grip enabling the implement to be gripped to assist in unfolding the implement from the storage position, wherein the hinge further includes at least one frangible tab such that severing of the frangible tab detaches the implement from the cover portion so that if desired the implement can either be detached from the cover portion for use or be rotated about the hinge between the extended position and the storage position for storage of the implement against or in close proximity to the cover portion after use while remaining connected to the cover portion.

2. The lid recited in claim 1, wherein the implement is rotatable through an angle of about 180° between the extended position and the storage position.

3. The lid recited in claim 1, wherein the frangible tab is severable by movement of the implement about the hinge in an opposite or reverse direction of a normal direction of movement of the hinge from the extended position into the storage position.

4. The lid recited in claim 1, wherein the cover portion, implement, and hinge are formed integrally with each other.

5. The lid recited in claim 1, wherein the cover portion further comprises a retainer for retaining the implement in the storage position.

6. The lid recited in claim 5, wherein the retainer comprises at least one of a clip or a pair of spaced-apart bars, ridges, ribs, bosses, or protrusions.

7. The lid recited in claim 5, wherein at least a part on one or more of the side edges of the implement cooperatively engages with the retainer provided on a portion of the cover to retain the implement in the storage position.

8. The lid recited in claim 1, wherein the cover portion has a recess for receiving at least a part of the implement when in the storage position.

9. The lid recited in claim 8, wherein the recess is located on an inner surface of the lid in use and is of a complementary or corresponding shape to a shape of the implement for receiving a substantial portion of the implement when in the storage position.

10. The lid recited in claim 9, wherein the implement comprises a handle portion for holding the implement and a contact portion for contacting the contents of the container, wherein when the implement is in the storage position at least a part of the handle portion of the implement and a part of the content contacting portion of the implement are received in the recess formed in the cover portion.

11. The lid recited in claim 8, wherein the edge of the implement cooperatively engages with a side wall of the recess to retain the implement in the recess.

12. The lid recited in claim 8, wherein the cover portion comprises a stiffening rib for defining at least a portion of the recess.

13. The lid recited in claim 1, wherein the lower part of the side skirt includes a lip adapted to engage an underside of the upper peripheral rim of the container to secure the lid to the container.

14. The lid recited in claim 13, wherein the cavity is further defined by a sealing sheet or membrane attached to the cover portion or to the container.

15. The lid recited in claim 1, wherein the cover portion includes at least one flat panel.

16. The lid recited in claim 15, wherein the cover portion has a plurality of flat panels formed in the cover portion such that the flat panels are arranged coplanar with each other.

17. The lid recited in claim 1, wherein the lower part of the side skirt is provided with a surface such that the surface is arranged to abut an upper peripheral rim of the container to which the lid is to be attached or to abut a sealing sheet adhering to the upper peripheral rim to assist in attaching the lid to the container.

18. The lid recited in claim 1, wherein the lid comprises an indicator comprising at least one of an antitamper device, a tamper-evident device, or a tamper-resistant or tamper-proof arrangement for providing an indication of unauthorized access to the container, lid, cover portion, and contents of the container.

19. The lid recited in claim 18, wherein the indicator is included as part of or located at least partially around the side skirt of the lid.

20. The lid recited in claim 19, wherein the indicator comprises the lower part of the side skirt which is adapted to engage at least a part of an upper peripheral rim of the container.

21. The lid recited in claim 20, wherein the peripheral skirt is integrally formed with the cover portion.

22. The lid recited in claim 21, wherein the lower part of the side skirt comprises a lip adapted to engage an underside of the upper peripheral rim of the container to assist in attaching the lid to the container.

23. The lid recited in claim 20, wherein the lid has a frangible region formed in the lower part of the side skirt so that a part of the side skirt is separable from the cover portion along at least a part of the length of the side skirt to assist in gaining access to the contents of the container and for removing the lid from the container.

24. The lid recited in claim 23, wherein the frangible region extends along a part of the junction between the cover portion and part of the side skirt so that the lid may be removed from the container by separating part of the side skirt from the cover portion at the frangible region without fully separating the remaining part of the side skirt from the cover portion.

25. The lid recited in claim 24, wherein the frangible region comprises a groove formed in one of the cover portion and the side skirt.

26. The lid recited in claim 25, wherein the frangible region comprises a plurality of frangible tabs defining slots therebetween.

27. The lid recited in claim 24, wherein the side skirt further includes a tab adapted to be grasped and pulled for separating the side skirt from the cover portion at the frangible region, thereby providing an indication of unauthorized access to the container.

28. The lid recited in claim 24, wherein the frangible region is in spaced apart relation from the hinge, so that when the side skirt is separated from the cover portion the area around the hinge remains intact, thereby maintaining the implement integrally connected with the cover portion.

29. The lid recited in claim 1, wherein the cover portion and the implement comprise a molded flexible plastics material.

30. The lid recited in claim 29, wherein the plastics material is substantially transparent.

31. The lid recited in claim 1, wherein the implement comprises a head portion and a stem portion, the stem portion hingedly connected to the lower part of the side skirt.

32. The lid recited in claim 28, wherein the implement further comprises a pair of foldable arms located on either side of the implement and arranged such that respective proximal ends of the arms are connected to either side of the stem portion and respective distal ends of the arms are connected to each other in the region of the head portion of the implement.

33. The lid recited in claim 32, wherein the respective proximal portions of the arms are connected to the stem portion by respective fold lines and the respective distal portions of the arms are connected to each other along a fold line.

34. The lid recited in claim 33, wherein the two arms surrounding the implement are foldable out of a plane of the implement to form a handle arrangement wherein the two arms are securely fastened to each other.

35. The lid recited in claim 34, wherein the head portion of the implement is foldable with respect to the stem portion of the implement and fastenable thereto so that the head portion is angularly inclined to the pair of arms in side-by-side secured relationship.

36. The lid recited in claim 1, wherein a length of the implement is extended beyond a size of the container for facilitating a removal of contents from the container.

37. A lidded container comprising a container and a lid, the lid comprising a cover portion adapted to extend over a container, said cover portion comprising a side skirt having an upper part and a lower part extending continuously around the perimeter of the cover portion for engaging with the container to attach the cover portion to the container in use, an implement adapted for use with contents of the container to assist in removal of the contents from the container and a hinge connecting the implement to the lower part of the side skirt, said lower part of the side skirt having no gaps or spaces in the region where the hinge is connected to the lower part of the side skirt, said hinge allowing the implement to be rotated about the hinge between a storage position in which the implement lies against or is in close proximity to a part of the cover portion and an in use position in which the implement extends outwardly of the lid or cover portion to enable the implement to be used to remove contents from the container, said implement including a grip enabling the implement to be gripped to assist unfolding the implement from the storage position, wherein the hinge further includes at least one frangible tab such that severing of the frangible tab detaches the implement from the cover portion so that if desired the implement can either be detached from the cover portion for use or be rotated about the hinge from the extended position to the storage position for storage of the implement against or in close proximity to the cover portion after use while remaining connected to the cover portion.

38. The lidded container recited in claim 37, wherein the lid further comprises engagement means on an upper surface thereof adapted to receive in stacking relation a lower surface of a second container, so that when the lid is attached to the container a plurality of lidded containers are stackable by the lower surfaces of the containers being received in the engagement means so as to form an array of stacked or nested containers.

39. The lidded container recited in claim 37, further comprising a sealing membrane attached to an upper peripheral rim of the container, the sealing membrane further defining the cavity.

40. A method of manufacturing a lid for a container, the method comprising the steps of:

making a lid comprising a cover portion adapted to extend over a container, said cover portion comprising a side skirt having an upper part and a lower part extending continuously around the perimeter of the cover portion for engaging with the container to attach the cover portion to the container in use, an implement adapted for use with contents of the container to assist in removal of the contents from the container, and a hinge connecting the implement to the lower part of the side skirt, said lower part of the side skirt having no gaps or spaces in the region where the hinge is connected to the lower part of the side skirt; and providing a frangible hinge between the implement first end and the side skirt, the hinge permitting implement motion between a storage position in which the implement lies against or in close proximity to a part of the cover portion and an extended position wherein a second end of the implement is in spaced relation from the cover portion, so that if desired for use, the implement can either be detached from the cover portion or be rotated about the hinge between the extended position and the storage position while remaining connected to the cover portion.

41. The method recited in claim 40, further comprising the step of attaching a sealing membrane to an upper peripheral rim of the container, the sealing membrane further defining a cavity between the container and the cover portion.

* * * * *